US006279911B1

(12) United States Patent
Cherry

(10) Patent No.: US 6,279,911 B1
(45) Date of Patent: Aug. 28, 2001

(54) WORD GAME

(75) Inventor: Eric Cherry, Highland Beach, FL (US)

(73) Assignee: Horse Sense Corporation, Delray Beach, FL (US)

( * ) Notice: Subject to any disclaimer, the term of this patent is extended or adjusted under 35 U.S.C. 154(b) by 0 days.

(21) Appl. No.: 09/382,073

(22) Filed: Aug. 24, 1999

(51) Int. Cl.[7] ..... A63F 1/00

(52) U.S. Cl. ..... 273/299; 273/153 R; 273/272; 273/299

(58) Field of Search ..... 273/153 R, 292, 273/299, 429, 272

(56) References Cited

U.S. PATENT DOCUMENTS 4,215,864 * 8/1980 Nochols .
5,207,435 * 5/1993 Tanner .
5,740,243 * 4/1998 Rehm .

OTHER PUBLICATIONS

"Jumble for Kids" Washington Post publication feature in the comic section, has been in publication for many years.*

* cited by examiner

*Primary Examiner*—Benjamin H. Layno
*Assistant Examiner*—V. Mendiratta
(74) *Attorney, Agent, or Firm*—Kirkpatrick & Lockhart LLP

(57) ABSTRACT

A word game includes providing a player with the number of letters in a mystery word, but not providing the mystery word itself. The player reveals or receives one or more game words and corresponding numbers of letters in each of the game words that are present in the mystery word. The player determines an answer word that the player believes to be the mystery word, and the answer word is compared to the mystery word. The player may win the game if the answer word is the same as the mystery word. The game may be played by one or more players, and may be played in a printed format or with game cards.

12 Claims, 4 Drawing Sheets

WORD GAME

BACKGROUND OF THE INVENTION

The invention relates generally to a word game, and in particular, a deduction or guessing game involving letters and words.

Deduction or guessing games involving letters and words are found, e.g., on television, in books, and in newspapers. Such games require varying levels of skill.

SUMMARY OF THE INVENTION

In general, in one aspect, the invention features a method of playing a word game by a player. A mystery word which is unknown to the player is provided. The number of letters in the mystery word is revealed to the player. The player is provided a first game word and a number of letters in the first game word that are present in the mystery word. The player determines an answer word that the player believes to be the mystery word, and the answer word is compared to the mystery word.

Implementations of the invention may also include one or more of the following features. The player may win the game if the answer word is the same as the mystery word. The player may be awarded points based on a difficulty level associated with the mystery word. The player may be provided a second game word and a number of letters in the second game word that are present in the mystery word. The player may also be provided a clue relating to the mystery word.

In general, in another aspect, the invention features a method of playing a word game by a player. A mystery word which is unknown to the player is provided. The number of letters in the mystery word is revealed to the player. The player is provided a plurality of pairs of game words and numbers of letters in each of the game words that are present in the mystery word. The player determines an answer word that the player believes to be the mystery word, and the answer word is compared to the mystery word.

Implementations of the invention may also include one or more of the following features. The player may win the game if the answer word is the same as the mystery word. The player may be awarded points based on a number of game words used to correctly determine the mystery word.

In general, in another aspect, the invention features a word game for play by a player. A first card indicates a number of letters in a mystery word. A second card includes a game word and a number of letters in the game word that are present in the mystery word. The player determines an answer word that the player believes to be the mystery word based on the number of letters in the mystery word, the game word and the number of letters in the game word that are present in the mystery word, the player winning the game if the answer word is the same as the mystery word.

Implementations of the invention may also include one or more of the following features. The first card may include the mystery word, and may also include an opaque scratch-off coating disposed over the mystery word. The second card may also include an opaque scratch-off coating disposed over the game word and the number of letters in the game word that are present in the mystery word.

The first card may include a clue relating to the mystery word. The game word may also be a clue relating to the mystery word.

The mystery word may be printed at a remote location. The first card and the second card may form a single combined card.

In general, in another aspect, the invention features a word game for play by a player. A first card indicates a number of letters in a mystery word. A second card includes a plurality of pairs of game words and numbers of letters in each of the game words that are present in the mystery word. The player determines an answer word that the player believes to be the mystery word based on the number of letters in the mystery word and the pairs of game word and numbers of letters in each of the game words that are present in the mystery word, the player winning the game if the answer word is the same as the mystery word.

In general, in another aspect, the invention features a word game for play by a player. A card includes a mystery word, a number of letters in the mystery word, and a plurality of pairs of game words and numbers of letters in each of the game words that are present in the mystery word. The player determines an answer word that the player believes to be the mystery word based on the number of letters in the mystery word and the pairs of game words and numbers of letters in each of the game words that are present in the mystery word, the player winning the game if the answer word is the same as the mystery word.

Implementations of the invention may also include one or more of the following features. The game may be played by the player and an opponent, and the card is only revealed to the opponent. The player and the opponent may each be determining an answer word that the player or the opponent believes to be a mystery word, the player and the opponent taking turns providing to each other one of the pairs of game words and numbers of letters in each of the game words that are present in the other's mystery word.

The card may include an opaque scratch-off coating disposed over the mystery word or an opaque scratch-off coating disposed over the pairs of game words and numbers of letters in each of the game words that are present in the mystery word.

In general, in another aspect, the invention features a method of playing a word game by a first player and a second player. A mystery word is provided to the second player, the mystery word being unknown to the first player. The number of letters in the mystery word is revealed to the first player by the second player. The second player provides to the first player a game word and a number of letters in the game word that are present in the mystery word. The first player determines an answer word that the first player believes to be the mystery word, and the second player compares the answer word to the mystery word.

Implementations of the invention may also include one or more of the following features. The first player may win the game if the answer word is the same as the mystery word. The game may end after a predetermined period of time.

In general, in another aspect, the invention features a method of playing a word game by a first player and a second player. A mystery word is provided to the second player, the mystery word being unknown to the first player. The number of letters in the mystery word is revealed to the first player by the second player. A game word is provided by the first player. The second player informs the first player of a number of letters in the game word that are present in the mystery word. The first player determines an answer word that the first player believes to be the mystery word, and the second player compares the answer word to the mystery word.

In general, in another aspect, the invention features an electronic game device for playing a word game by a player. A display device displays a number of letters in a mystery word, a game word, and a number of letters in the game word that are present in the mystery word. A keyboard is used by the player to enter an answer word that the player believes to be the mystery word. A processor connected to the display device and the keyboard stores the mystery word, the number of letters in the mystery word, the game word and the number of letters in the game word, and compares the answer word to the mystery word. The player wins the game if the answer word is the same as the mystery word.

Implementations of the invention may also include one or more of the following features. The display device may include a screen. The processor may store a plurality of pairs of game words and numbers of letters in each of the game words that are present in the mystery word, the display being capable of displaying each pair of game words and numbers of letters in each of the game words that are present in the mystery word. The processor may progressively add to the display one of the pairs of game words and numbers of letters in each of the game words that are present in the mystery word.

The present invention has the advantage that it is a simple game that can be played by one or more players.

The present invention has the further advantage that it requires little or no equipment to play the game.

Other features and advantages of the invention will become apparent from the following detailed description, and from the claims.

DESCRIPTION OF THE PREFERRED EMBODIMENTS

Figure 1:
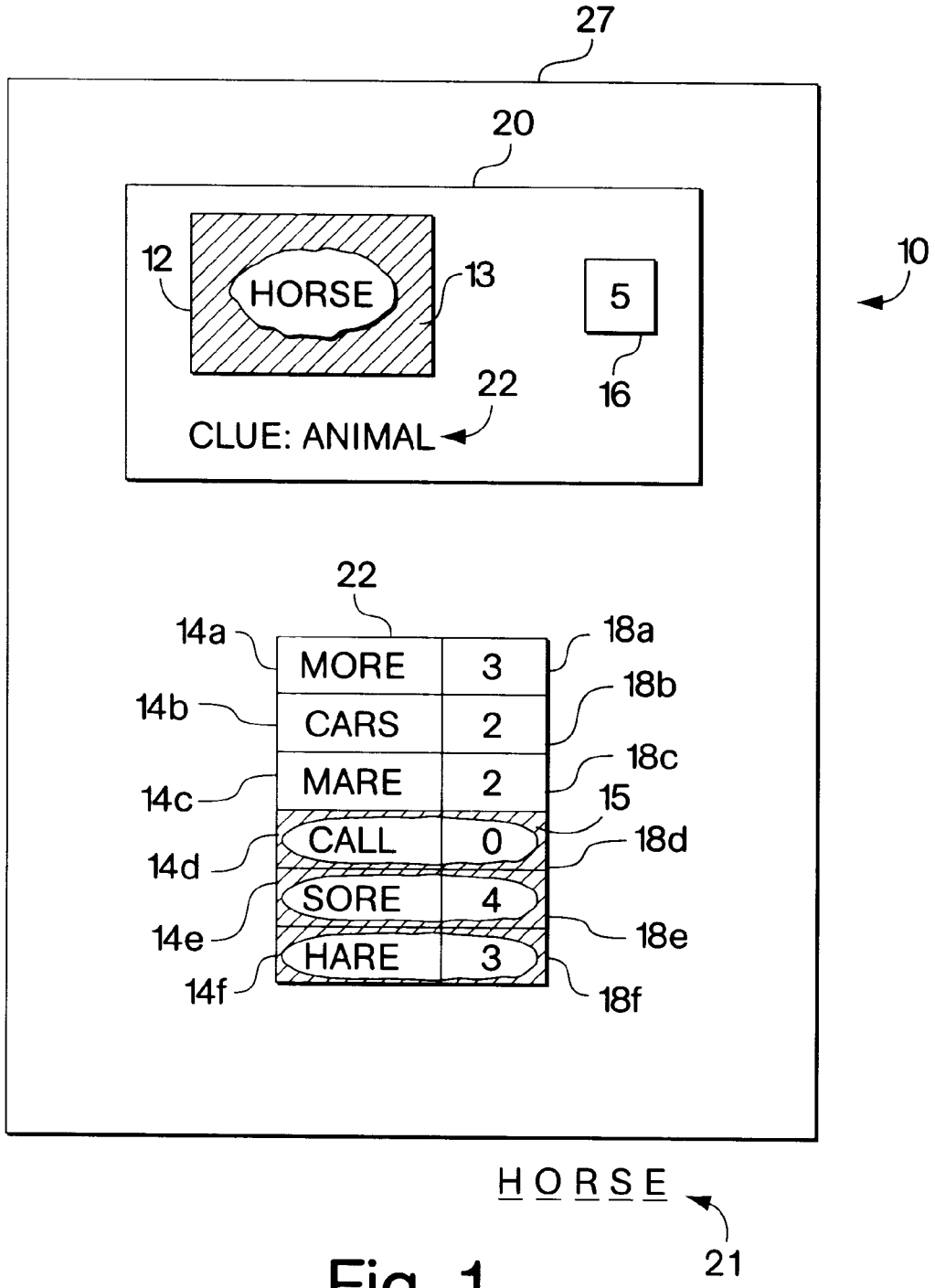
FIG. 1 shows the word game of the present invention for play by a single player.

FIG. 1 shows the word game of the present invention for play by a single player. Word game 10 includes a mystery word 12 and a plurality of game words 14*a* . . . 14*f*. The player is initially given only the number of letters 16 in mystery word 12, but not mystery word 12 itself. The object of the game is to deduce or guess the mystery word given the number of matching letters in each of the game words that are also present in the mystery word and by arranging possible letter combinations based on this information.

Mystery word 12 and the number of letters 16 in mystery word 12 may be printed on a card 20. Mystery word 12 may be hidden from the player, e.g., by being printed under an opaque scratch-off latex coating 13 on card 20. Alternatively, mystery word 12 may be hidden from the player by being printed at a remote location.

Game words 14*a* . . . 14*f* are provided to assist the player in deducing or guessing unknown mystery word 12. Associated with each game word 14*a* . . . 14*f* is a number of matching letters 18*a* . . . 18*f*. Each number of matching letters 18*a* . . . 18*f* indicates how many letters in the corresponding game word are also found in mystery word 12. Preferably, the number of matching letters 18*a* . . . 18*f* does not indicate how may times each of the matching letters occurs in mystery word 12. Alternatively, there may be an indication that one or more of the letters of a particular game word 14*a* . . . 14*f* occur more than once in mystery word 12.

Pairs of game words 14*a* . . . 14*f* and numbers of matching letters 18*a* . . . 18*f* may be provided to the player in a printed list or on a second card 22. Alternatively, the game words and the numbers of matching letters may be provided to the player on the same combined card 27 that contains mystery word 12; i.e., there may only be a single card needed to play the game.

Preferably, pairs of game words 14*a* . . . 14*f* and numbers of matching letters 18*a* . . . 18*f* are provided to the player one at a time, e.g., by the player scratching off an opaque latex coating 15 on a card that conceals the game words and the numbers of matching letters. Alternatively, pairs of game words 14*a* . . . 14*f* and numbers of matching letters 18*a* . . . 18*f* may be provided to the player all at once, e.g., by printing the game words and the number of matching letters in a list provided to the player.

Over the course of game 10, one or more pairs of game words 14*a* . . . 14*f* and numbers of matching letters 18*a* . . . 18*f* may be disclosed to or considered by the player. The player uses the disclosed game words and the numbers of matching letters in each game word to attempt to deduce or guess mystery word 12. In particular, the player may use game words 14*a* . . . 14*f* and numbers of matching letters 18*a* . . . 18*f* to deduce which letters must be in mystery word 12 and which letters cannot be in the mystery word.

The player may provide an answer word 21, e.g., by writing a word which the player believes to be mystery word 12. The player then compares answer word 21 with mystery word 12, e.g., by scratching off latex coating 13 concealing the mystery word on card 20 or by looking for the mystery word printed at the remote location. If the player's answer word 21 matches mystery word 12, then the player wins the game. If the player's answer word 21 does not match mystery word 12, then the player loses the game.

Figure 2:
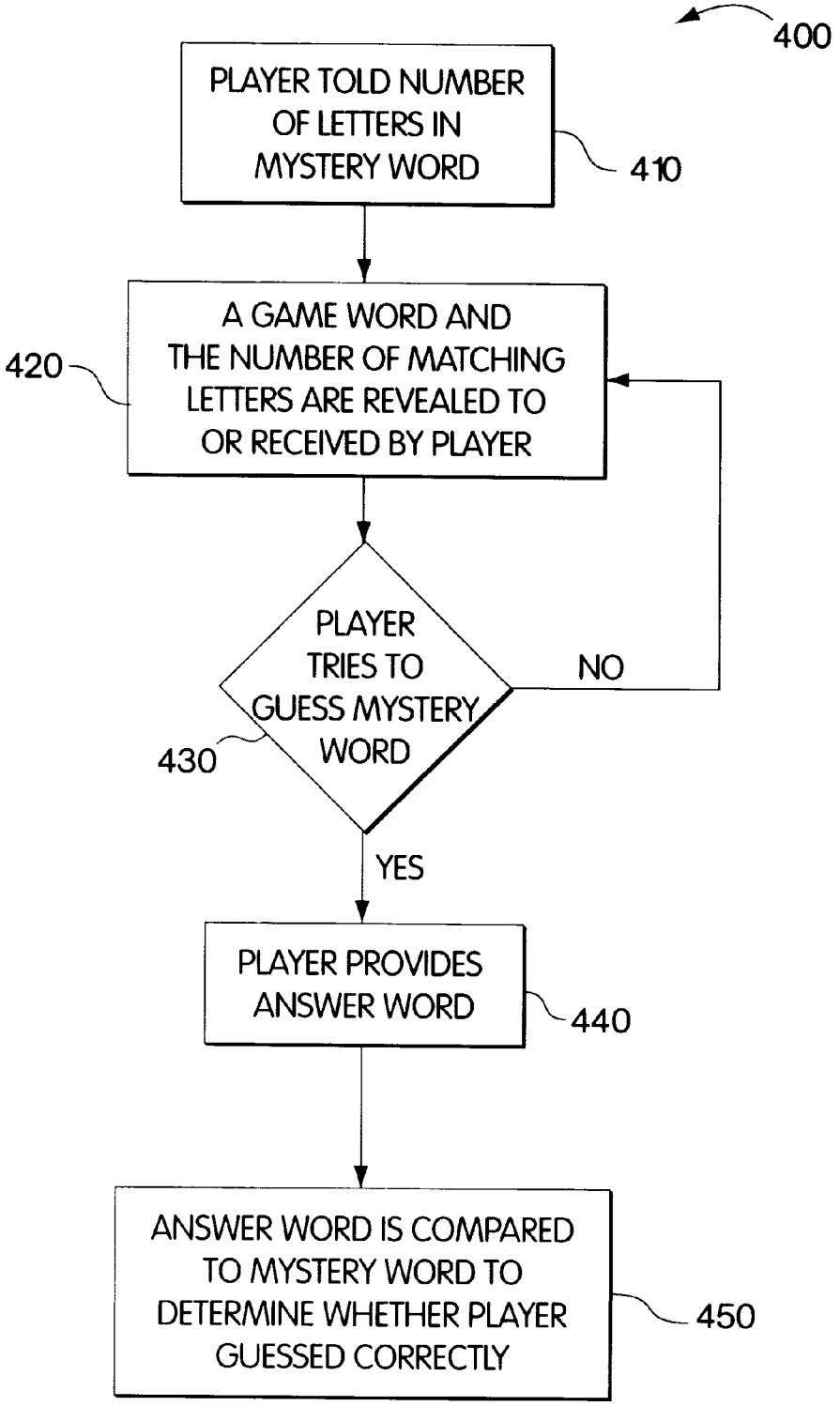
FIG. 2 is a flow chart showing a method of playing the word game of the present invention.

FIG. 2 is a flow chart showing a method 400 of playing the word game of the present invention. Using the example of FIG. 1, mystery word 12 is HORSE. The player of game 10 is told the number of letters 16 in mystery word 12 (step 410), i.e., five. The first game word 14*a* and the number of matching letters 18*a* is revealed to or received by the player (step 420). Three letters in game word 14*a* MORE (i.e., O, R and E) are also found in mystery word 12. The player is not told which three letters in game word 14*a* match the letters of mystery word 12, or how many times each of the letters may be present in mystery word 12.

The player may try to deduce or guess mystery word 12 after revealing or receiving the first game word 14*a* (step 430). If the player believes that he or she has figured out mystery word 12, the player may provide an answer word 21 (step 440). If the player has not deduced or guessed mystery word 12, the player may reveal or receive another game word 14*b* and the corresponding number of matching letters 18*b* (step 420). In this example, the player reveals or receives a second game word 14*b* CARS, for which two letters (i.e, R and S) are also found in mystery word 12. The player now knows that 3 letters from game word 14*a* MORE and 2 letters from game word 14*b* CARS are found in the five-letter mystery word. Again, the player can use this information to try to deduce or guess mystery word 12 and may provide an answer word 21, or the player may reveal or receive another game word 14*c* and corresponding number of matching letters 18*c*.

In this example, the player may subsequently reveal or receive four more game words 14*c* . . . 14*f*, i.e., MARE, CALL, SORE and HARE. The player would also be told that MARE has two letters (i.e., R and E), that are also found in mystery word 12, that CALL has no letters that are also found in mystery word 12, that all four letters of SORE are also found in mystery word 12, and that HARE has three letters (i.e, H, R and E) which are found in mystery word 12.

After being provided six game words 14*a* . . . 14*f*, the player can attempt to deduce or guess mystery word 12 and provide an answer word 21, e.g., HORSE. The answer word is then compared to the mystery word to determine whether the player has correctly determined the mystery word (step 450). Since the player's answer word 21 is the same as mystery word 12, the player wins game 10. Alternatively, if the player is playing a multi-round game, the player would win that round of the game. If the player's answer word 21 did not match mystery word 12, the player would have lost game 10 or that round of the multi-round game.

Game 10 may be played with several variations. For example, game words 14*a* . . . 14*f* may be provided one word at a time, until a maximum number of game words has been provided, or until a set period of time has elapsed. A player may be awarded points based on a difficulty level associated with a mystery word which has been determined correctly, or based on how many or how few game words were revealed or received before providing an answer word that is the same as the mystery word.

In an alternative embodiment, the player is provided with an additional clue or clues for deducing or guessing mystery word 12. The additional clue may be in the form of a printed word 22 (FIG. 1) with a meaning that relates to or suggests mystery word 12, or the clue may be in the form of one or more game words 14*a* . . . 14*f* having a meaning that relates to or suggests mystery word 12. For example, in FIG. 1, printed word clue 22 indicates that mystery word 12 is an "animal," since a "horse" is a type of animal. Game word 14*c* provides another clue because a "mare" is a female "horse."

Figure 3:
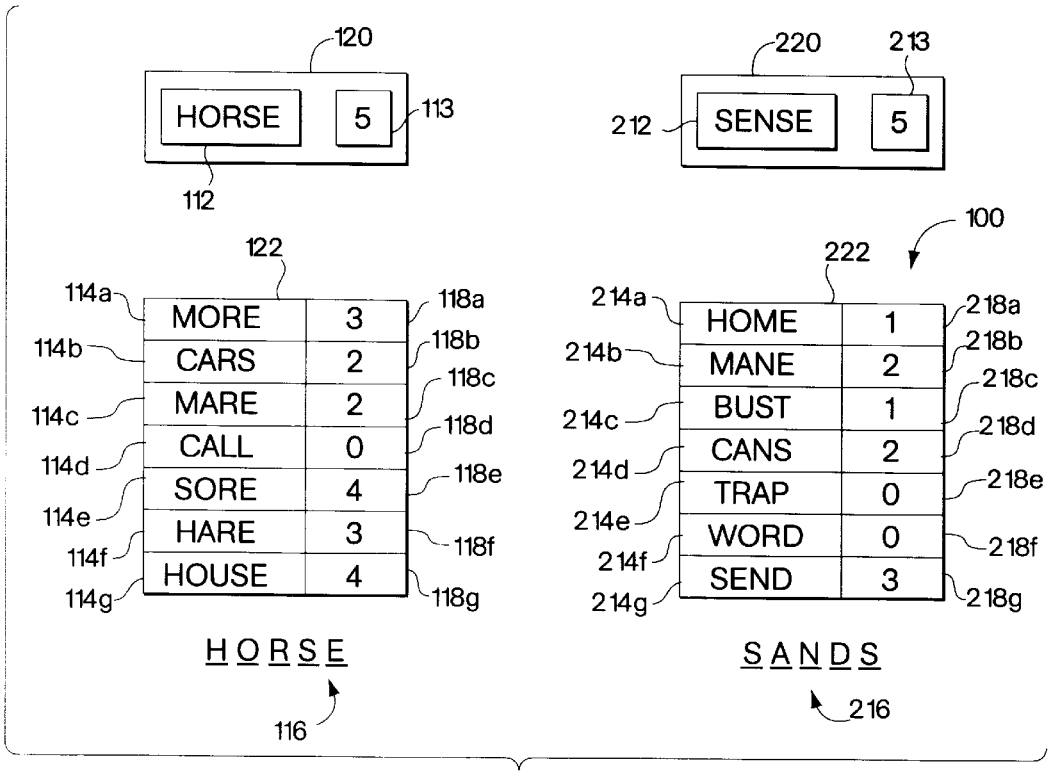
FIG. 3 shows another embodiment of the word game of the present invention for play by two or more players.

FIG. 3 shows the word game of the present invention for play by two or more players. In word game 100, each player competes against the other player or players. Word game 100 includes mystery words 112 and 212 and game words 114*a* . . . 114*g* and 212*a* . . . 214*g*. Mystery words 112 and 212 may be provided on cards 120 and 220.

In game 100, each player attempts to deduce or guess his or her mystery word before the other players have deduced or guessed their mystery words. Alternatively, each player attempts to earn either more points or fewer points during play of the game than the other players earn, depending on the scheme for awarding points to the players. For example, if a player is awarded one point for each game word used to deduce or guess the mystery word correctly, the goal is to earn as few points as possible. If a player is awarded points based on the difficultly of each word correctly deduced or guessed, the goal is to earn as many points as possible.

In FIG. 3, a first player attempts to deduce or guess mystery word 112 on card 120, here HORSE, and player 2 attempts to deduce or guess mystery word 212 on card 220, here SENSE. The first player is given the number of letters 113 in mystery word 112, and the second player is given the number of letters 213 in mystery word 212. The mystery words HORSE (112) and SENSE (212) both have five letters, but this could vary depending on which mystery words have been selected. The first player is then provided a plurality of game words 114*a* . . . 114*g* and the number of matching letters 118*a* . . . 118*g* for each of the game words. Similarly, the second player is provided a plurality of game words 214*a* . . . 214*g* and the number of matching letters 218*a* . . . 218*g* for each of the game words.

Each of game words 114*a* . . . 114*g* and 214*a* . . . 214*g* is preferably revealed to the player one word at a time. Alternatively, the player may receive all of the game words for a particular mystery word 112 or 212 as a group. If they are revealed one at a time, the game words and corresponding numbers of matching letters may be provided to the player by one of the opposing players who holds a card 122 or 222 hidden from the first player's view which contains game words 114*a* . . . 114*g* or 214*a* . . . 214*g*.

The players may take turns attempting to deduce or guess their mystery words using the game words and numbers of matching letters that they have received. The players may provide their deduced or guessed answer words 116 and 216 after a predetermined period of time, after a set number of game words have been disclosed, or whenever a player believes that he or she knows the mystery word that the player is attempting to deduce or guess. The first player to successfully determine his or her mystery word wins the game 100 or the round of the game if the players are playing a multi-round game.

In the example of FIG. 3, the first player with mystery word 112 HORSE wins the game because the answer word 116 provided by the player is the same as mystery word 112. The second player, i.e., the opponent, with mystery word 212 SENSE loses the game because the guessed answer word 216 is not the same as mystery word 212. If both players provided answer words that were the same as their respective mystery words, new mystery words could be issued to continue the game or round of games. If neither player provided an answer word that was the same as his or her mystery word, the game could continue until one of the players correctly deduces or guesses the mystery word or until all of the available game words have been provided to the players.

Game 100 can be set to run for a given period of time, or preferably based on a given number of game words. A player may be awarded bonus points based on how quickly he or she determines the mystery word or based on how long it takes the player's opponents to determine their mystery words.

In an alternative embodiment of multi-player game 100, each player may be given the opportunity to guess or otherwise provide the game words to be used with respect to the player's mystery word. For each game word selected in this manner, the opponent players, a neutral judge or even a computer in a computer-based game can tell the player the number of letters in the player's selected game word that are found in the mystery word which the player is trying to deduce or guess. For example, the first player who is trying to determine mystery word 112 HORSE may have selected game word 114*a* MORE as his own game word. The second player, who knows that mystery word 112 is HORSE, tells the first player that three letters in the word MORE are also found in the mystery word. This method of selecting game words may increase the skill levels of game 100 and lengthen the time it takes to complete the game.

The game of the present invention can be played via a syndicated newspaper or periodical. Using the example of FIG. 1, the number of letters 16 of mystery word 12, and all of the game words 14*a* . . . 14*f* and numbers of matching letters 18*a* . . . 18*f* are printed in a newspaper or periodical. Mystery word 12 may be printed in another location of the newspaper or periodical, or in a subsequent edition of the newspaper or periodical. The player may use all or some of the game words 14*a* . . . 14 and numbers of matching letters 18*a* . . . 18*f* to attempt to deduce mystery word 12 by guessing an answer word 21. The player may calculate a score based on the difficulty of the mystery word or the number of game words 14*a* . . . 14*f* used to correctly deduce or guess the mystery word.

The word game of the present invention may be implemented as an electronic video or computer game to be played in a gaming environment or even a remote location, such as a player's home. The game may also be played via an electronic communications network, e.g., the internet.

Figure 4:
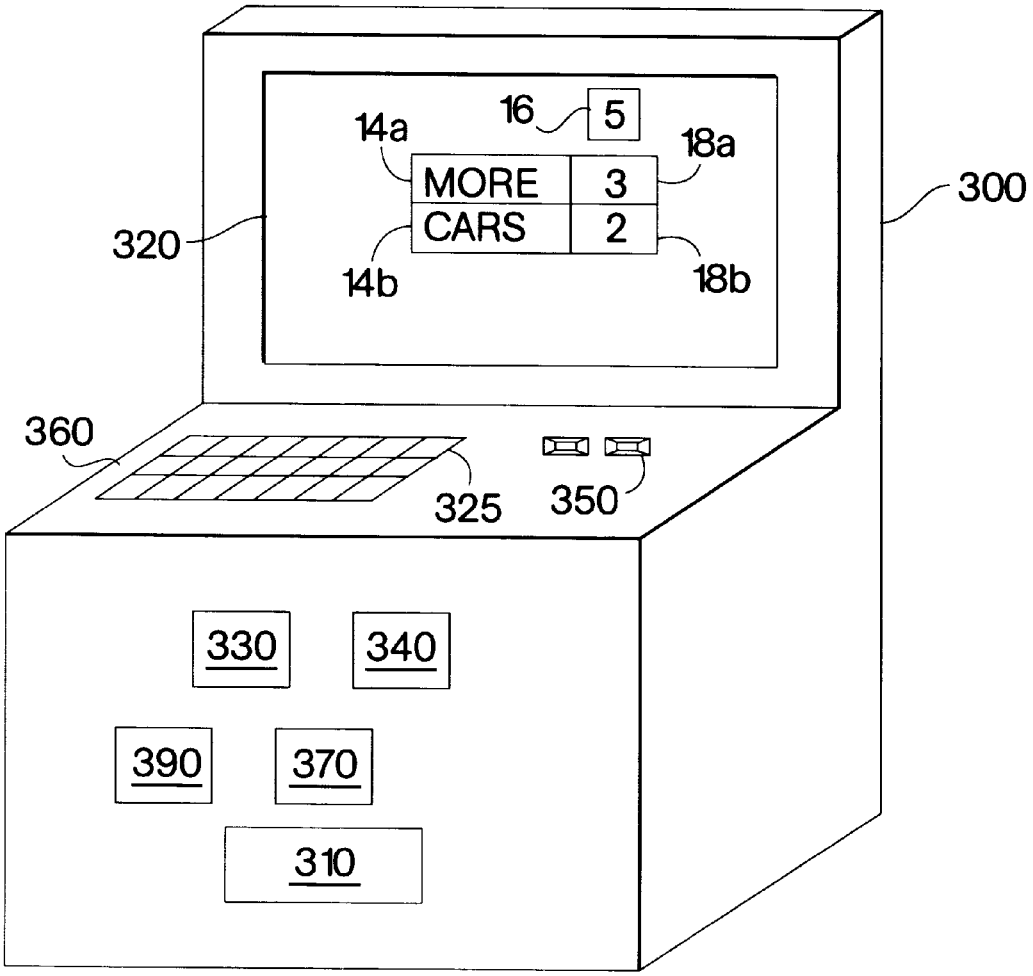
FIG. 4 is a somewhat diagrammatic sketch of an electronic gaming machine for playing the word game of the present invention.

As shown in FIG. 4, the electronic game may include a processor 310 in a gaming machine 300. The player views a display device, e.g., a screen 320, showing the number of letters 16 in mystery word 12 and disclosed game words 14*a*, 14*b* and the corresponding numbers of matching letters 18*a*, 18*b*. Game machine 300 also includes a keyboard 325 with keys corresponding to the letters of the alphabet.

A player may play the word game of the present invention at game machine 300 by inserting a predetermined amount of money into a coin slot 330 or a bill collecting device 340. Once the predetermined amount of money has been inserted, the game commences and is displayed to the player on screen 320.

Before processor 310 causes game machine 300 to display the number of letters 16 in mystery word 12, the player may place a wager by pressing buttons 350 on a console 360 of game machine 300, or by touching a touch-sensitive screen 320. Processor 310 then causes screen 320 to progressively reveal or display pairs of game words 14*a* . . . 14*f* and numbers of matching letters 18*a* . . . 18*f* one at a time, each time allowing the player to deduce or guess an answer word. The player may indicate his or her belief that he or she has correctly guessed the mystery word by typing the deduced or guessed answer word onto keyboard 325. The processor then determines whether the answer word is the same as the mystery word, and indicates on screen 320 whether the player has won or lost the game. Processor 310 may also allow two or more players to play against each other, and determines a winning player by comparing the scores of the players after a game or a round of games.

If the player at game machine 300 has won a game or round of games, processor 310 may calculate a payout based on the player's wager. Game machine 300 may either dispense the payout to the player through a payout dispenser 370 or credit an account maintained by processor 310 against which the player may play further games on game machine 300. Communications between similar game machines may be accomplished, e.g., using a modem 390 in each game machine 300 that may transmit data over a network, e.g., the public telephone network.

Other embodiments are within the scope of the following claims.

What is claimed is:

1. A method of playing a word game by a player, comprising:

providing a mystery word which is unknown to the player;

revealing to the player the number of letters in the mystery word;

providing to the player a first game word and a number of letters in the first game word that are present in the mystery word, such that rearranging the letters of the game word does not provide an indication of which letters of the game word are present in the mystery word;

determining an answer word that the player believes to be the mystery word; and comparing the answer word to the mystery word.

2. The method of claim 1 wherein the player wins the game if the answer word is the same as the mystery word.

3. The method of claim 2 further comprising awarding points to the player based on a difficulty level associated with the mystery word.

4. The method of claim 1 further comprising providing to the player a second game word and a number of letters in the second game word that are present in the mystery word.

5. The method of claim 1 further comprising providing to the player a clue relating to the mystery word.

6. A method of playing a word game by a player, comprising:

providing a mystery word which is unknown to the player;

revealing to the player the number of letters in the mystery word;

providing to the player a plurality of pairs of game words and numbers of letters in each of the game words that are present in the mystery word, such that rearranging the letters of the game words does not provide an indication of which letters of the game words are present in the mystery word;

determining an answer word that the player believes to be the mystery word; and comparing the answer word to the mystery word.

7. The method of claim 6 wherein the player wins the game if the answer word is the same as the mystery word.

8. The method of claim 7 further comprising awarding points to the player based on a number of game words used to correctly determine the mystery word.

9. A method of playing a word game by a first player and a second player, comprising:

providing a mystery word to the second player, the mystery word being unknown to the first player;

revealing the number of letters in the mystery word to the first player by the second player;

providing to the first player by the second player a game word and a number of letters in the game word that are present in the mystery word, such that rearranging the letters of the game word does not provide an indication of which letters of the game word are present in the mystery word;

determining an answer word that the first player believes to be the mystery word; and comparing the answer word to the mystery word by the second player.

10. The method of claim 9 wherein the first player wins the game if the answer word is the same as the mystery word.

11. The method of claim 9 wherein the game ends after a predetermined period of time.

12. A method of playing a word game by a first player and a second player, comprising:

providing a mystery word to the second player, the mystery word being unknown to the first player;

revealing the number of letters in the mystery word to the first player by the second player;

providing a game word by the first player;

informing the first player, by the second player, of a number of letters in the game word that are present in the mystery word, such that rearranging the letters of the game word does not provide an indication of which letters of the game word are present in the mystery word;

determining an answer word that the first player believes to be the mystery word; and comparing the answer word to the mystery word by the second player.

* * * * *